United States Patent [19]

Svendsen

[11] Patent Number: 4,518,845

[45] Date of Patent: May 21, 1985

[54] DEVICE FOR PROCESSING THERMALLY DEVELOPABLE FILMS AND PAPERS

[75] Inventor: John A. Svendsen, May Township, Washington County, Minn.

[73] Assignee: Minnesota Mining and Manufacturing Company, St. Paul, Minn.

[21] Appl. No.: 438,752

[22] Filed: Nov. 3, 1982

[51] Int. Cl.[3] ..... H05B 1/00; G03D 15/02

[52] U.S. Cl. ..... 219/216; 219/388; 219/469; 34/140

[58] Field of Search ..... 219/216, 469, 470, 471, 219/388; 432/230; 38/56; 34/110, 140, 41; 100/210, 156, 93 RP, 93 PB; 355/3 FU

[56] References Cited

U.S. PATENT DOCUMENTS

| | | | |
|---|---|---|---|
| 3,012,141 | 12/1961 | Thomiszer | 250/65 |
| 3,032,811 | 5/1962 | Knowland | 219/471 |
| 3,058,244 | 10/1962 | Jesus | 38/56 |
| 3,073,038 | 1/1963 | Dapses | 34/110 |
| 3,100,252 | 8/1963 | Shaler | 219/471 |
| 3,177,793 | 3/1965 | Stewart . | |
| 3,230,858 | 1/1966 | Brown et al. . | |
| 3,242,316 | 10/1963 | Cranskens | 219/471 |
| 3,243,579 | 3/1966 | Sussin | 219/469 |
| 3,394,245 | 7/1968 | Waldrop | 219/469 |
| 3,439,905 | 4/1969 | Alseth | 263/6 |
| 3,517,164 | 6/1970 | Huggins | 219/216 |
| 3,632,984 | 1/1972 | Brownscombe | 219/469 |
| 3,709,472 | 1/1973 | Kreitz et al. | 263/6 |
| 3,739,143 | 6/1973 | Amundson et al. | 219/216 |
| 3,757,662 | 9/1973 | Ingels | 34/41 |
| 3,893,245 | 7/1975 | Knechtel | 219/388 |

FOREIGN PATENT DOCUMENTS

| | | | |
|---|---|---|---|
| 1354819 | 10/1962 | France . | |
| 1418155 | 10/1964 | France . | |
| 52-76929 | 6/1977 | Japan | 355/3 FU |

OTHER PUBLICATIONS

"Developing 3M Brand Dry Silver Films and Papers", 3M Company, St. Paul, Minnesota (Jan. 1978).

*Primary Examiner*—Roy N. Evnall, Jr.
*Assistant Examiner*—Teresa J. Walberg
*Attorney, Agent, or Firm*—Donald M. Sell; James A. Smith; David L. Weinstein

[57] ABSTRACT

A device for high quality development of latent image on a strip of heat developable paper or film. The devices includes a heat conductive member which affords conduction of a uniform predetermined quantity of heat to all areas of the paper. The heat conductive member includes means to vent moisture from the paper to the atmosphere during the development process, to aid in bringing about uniform development of the paper or film. The heat conductive member may further include means to provide uniform pressure to the film or paper during the development process.

8 Claims, 10 Drawing Figures

DEVICE FOR PROCESSING THERMALLY DEVELOPABLE FILMS AND PAPERS

BACKGROUND

This invention relates to a device for processing thermally developable papers and films. More particularly, it relates to an apparatus which allows removal of evaporated moisture from thermally developable papers during thermal development so as to bring about uniform development.

A typical thermally developable paper or film comprises a base layer having a coating thereon of a photothermographic layer which comprises a binder, a photo-sensitive silver halide which photogenerates silver, a reducing agent for silver ions, and a reducible light-insensitive silver source (e.g., a salt), the reduction of which source is catalyzed by silver. The developed image is formed in the thermographic layer.

The development of a latent image in the photothermographic layer of a heat developable paper or film requires that the layer be maintained at a temperature within its development temperature range for a predetermined period of time. The period is shorter at higher development temperatures. One of the more difficult problems encountered in heating a thermally developable sheet of paper or film uniformly to create an image with no irregularities has been the presence of moisture in the sheet. When a sheet is heated, as by contact with a heating surface, moisture within the sheet creates pockets of steam between the sheet and the heating surface, causing non-uniform heat transfer and uneven mid-tone gray levels. When the moisture level of a paper sheet is very high, wrinkling of the sheet often occurs during development. In some cases, portions of the sheet are insufficiently heated and are not totally processed. Uniformity of heat transfer is critical. Even though a thermal developer apparatus may have adequate temperature control on the heating surface, the temperature experienced by the paper or film recording medium will be uniform only with uniform contact between the heating surface and recording medium.

Conventional thermal processing devices can be characterized as one of three types:

A. Rigid or semi-rigid hot shoe heating member and drive roller transport member;

B. Rigid platen heating member and belt drive transport member; and

C. Rigid drum heating member and paper/film supply roll transport member.

A hot shoe may be defined as a heated path or course that positions or otherwise influences, as by friction, the movement of a strip of exposed photothermographic paper or film in its passage through a development zone. A typical hot shoe can be described as a heated sleeve-like member, said member being semi-cylindrical in shape. The exposed photothermographic paper or film is contacted with the concave side of the semi-cylindrical sleeve-like member. A drive roller, a rotating cylinder which conforms to the shape of the concave side of the sleeve-like member, drives the paper or film over the heated path by means of a frictional driving force. The drive roller thus transports the paper or film through the heating region, allowing the paper or film to be heated by the sleeve-like member while providing pressure to keep the paper or film against the concave side of the member. In the situation described, the path or course which positions the strip of exposed paper or film is the area defined by the concave side of the sleeve-like member. Three basic hot shoe/roller developer devices exist:

1. The first is a semi-rigid shoe to which heat is supplied by means of a heat source such as a heating blanket bonded to the back side of the hot shoe;
2. The second is a smaller extruded rigid shoe with a cartridge heater of the type used in many microfilm and copying machines;
3. The third is a larger extruded rigid shoe with grooves formed therein to alleviate the moisture problem. The grooves are not open slots or holes in the shoe and do not easily allow moisture vapor to pass from the imageable sheet to the atmosphere during development.

The foregoing hot shoe/drive roller devices have no provision to allow moisture to escape from the heating zone. The entrapped moisture, combined with non-uniformities in pressure resulting from tolerance and concentricity imperfections between the hot shoe and drive roller, result in uneven processing, particularly under moisture conditions wherein the amount of moisture in the paper exceeds about 3.5 percent by weight.

SUMMARY OF THE INVENTION

This invention involves a device for processing thermally developable papers and films. The device comprises:

(a) means for heating the papers and films, which means define a heating zone, (b) means within said heating zone for allowing moisture from the papers and films to be vented to the atmosphere, and (c) means for applying pressure uniformly between the heating means and the papers and films.

Preferred embodiments of the invention also include means for conveying the papers and films to and from the zone where heat and pressure are applied. The papers and films are contacted against a heat conductive member which is characterized by having means for allowing moisture vapor to escape to the atmosphere. Examples of these moisture venting means include holes, slots, pores, and the like. Moisture vapor from the papers and films are vented away from the papers and films through these openings. In the preferred embodiments of the invention, the member against which the papers and films are pressed is comprised of a plurality of elongated elements, each of which is independently moveable and resiliently biased toward the pressure applying means so that imperfections in the elements and/or pressure applying means, e.g, depressions and/or protrusions, do not have the effect of producing non-uniform pressure levels on the surface of the papers and films during development. Each element is separated from the adjacent element by a narrow gap, space, separation, or the like. The moisture in the papers and films escapes through the separations between the elements. Pressure may be applied to the papers or films by forcing them against the member or elements (a) by means of a drive roller, as when the member is formed in the configuration of a cylindrical hot shoe, or (b) by means of a transport belt, or by means of a paper supply roll in combination with drive rollers, as when the member is formed in the configuration of a platen, drum, or other convex member. The means for applying pressure to the papers and films may also serve as the means for conveying the papers and films to and from the member.

The member is heated, and papers and films are heated by heat conduction from the member. The source of heat for the member may be supplied by heating blankets, cartridge heaters, electrodes, or the like.

The images developed by the device of the present invention exhibit an optical density value which is uniform, independent of the humidity and moisture content of the paper or film.

DETAILED DESCRIPTION

The device for thermally developing papers conducts at least two operations:

(1) heating the papers or films in order to develop the image or record; and (2) venting moisture from the papers or films to the atmosphere from the area where the papers or films are being heated.

Other operations which are highly desirable include:

(A) applying pressure uniformly to the papers or films to assure a uniformly developed image or record; and (B) conveying the papers or films to and from the developing zone, i.e., the zone where the papers or films are heated.

Although the number of embodiments which can be provided for this invention is virtually unlimited, all of the embodiments have the following characteristics in common—the papers or films are forced, under pressure, against a member which is formed in such a way that moisture borne by the papers or films and evaporated during heating can escape from the papers or films during thermal development.

Figure 1:
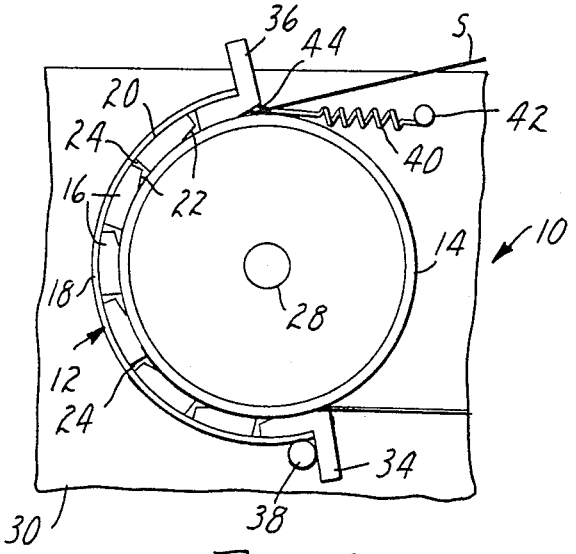
FIG. 1 is an elevational view of the preferred embodiment of a processing device constructed according to the present invention, some parts thereof removed.
Figure 3:
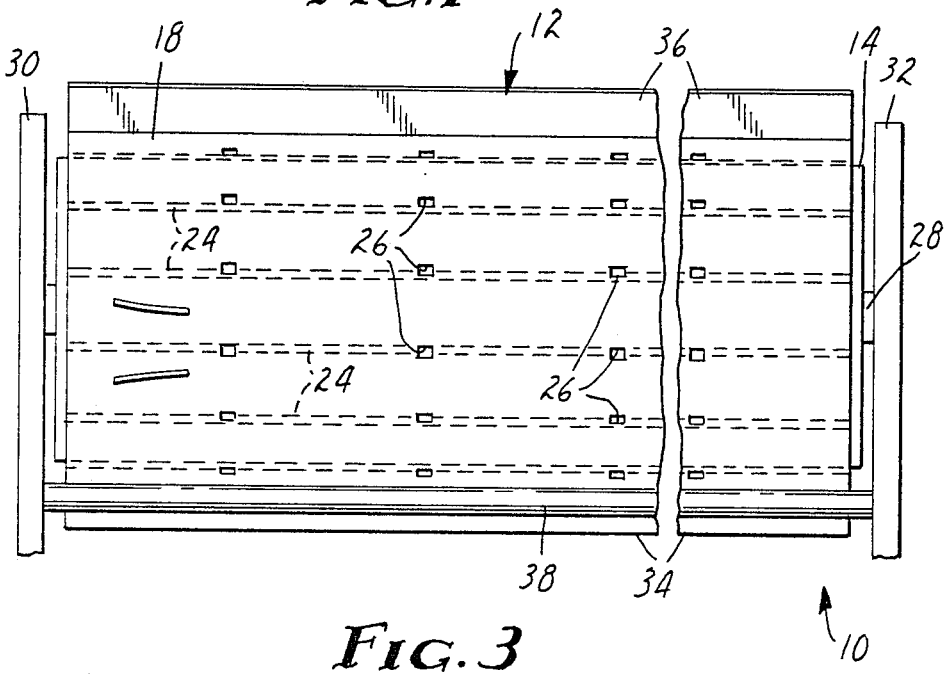
FIG. 3 is a rear view of FIG. 1.
Figure 2:
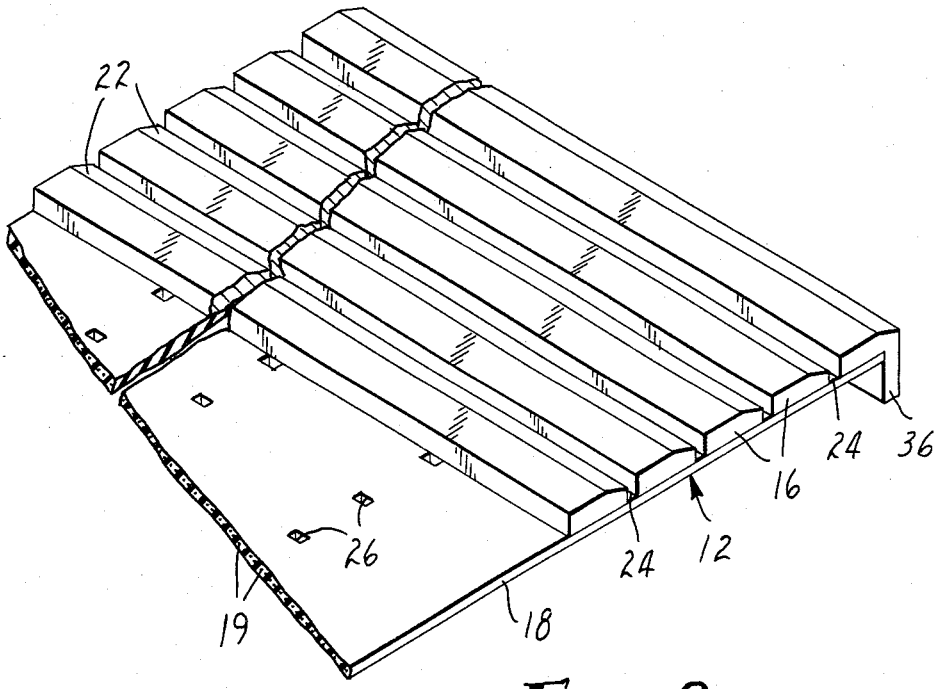
FIG. 2 is a perspective view of a portion of the heat conducting elements of the preferred embodiment, parts thereof broken away and shown in section.

The preferred embodiment of the processing device of the present invention is shown in FIGS. 1–3. The preferred embodiment includes a frame 10, the purpose of which is to support a heat conductive member 12 and a drive roller 14. The heat conductive member in this embodiment has a configuration similar to that of the hot shoe devices that are in current use. In this embodiment, a plurality of elongated elements 16, which are preferably in the shape of bars, are employed for conducting heat from the heat source 18 to the thermally imageable paper or film, hereinafter referred to as paper, and designated by the letter S.

The elements 16 may be made of any material which is capable of conducting heat. Suitable material include metals, ceramics, and certain plastics. Suitable metals include, but are not limited to, copper, aluminum, steel, iron, and alloys thereof. The heat conductive material must be capable of withstanding temperatures used in processing thermally developable papers and films, i.e., 90° to 180° C., preferably 100° to 135° C.

The simplest elements 16 exhibit a rectangular cross section. Other cross sections are also acceptable, e.g., elliptical, circular, and polygonal. However, a rectangular cross section is simple with respect to both construction and operation.

Figure 4:
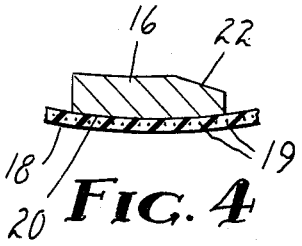
FIG. 4 is a cross-sectional view of one of the heat conducting elements of the preferred embodiment.

In the embodiment shown in FIG. 1, it should be noted that the surface 20 of the element 16 is slightly curved. This surface curvature is merely a matter of preference resulting from the fact that the heater 18 exhibits a cylindrical curvature when the device is in operation. The surface curvature of the heat conductive element 16 allows the element to be more easily accommodated by the heater 18. FIG. 4 shows the curved surface 20 of element 16.

The leading edge 22 of the element 16, i.e., the edge 22 first coming into contact with the paper S, is preferably beveled in order that the incoming paper S not snag on the element 16.

The heater 18 which heats the heat conductive elements 16 is shown, by way of example, as an electrically insulating web in which a multiplicity of fine resistant material heating elements 19 are embedded. The electrically insulating web may be made, for example, from silicone. The heater 18 should be designed to provide an even amount of heat flow through all areas of the heat conductive elements 16, and for this purpose may have an increased concentration of heating elements adjacent the ends of the heat conductive elements to offset thermal, edge fall-off effects. Electrical power to the heater is supplied through lead wires from a regulated power supply (not shown).

The drive roller 14 is preferably cylindrical in shape. The rotary action of the drive roller 14 conveys the paper S over the heat conductive elements 16 and in contact with the surfaces thereof. The speed of the roller 14 is controlled by the operator and regulated to allow adequate contact time of the paper S and the heat conductive elements 16.

The nature of the material covering the roller 14 is not critical. The surfaces of the drive rollers 14 should have adequate tack to provide good frictional driving contact for the paper S. Suitable covering materials include elastomeric materials, e.g. foam or solid, silicones, polyurethanes, natural and synthetic rubber, and flock, i.e., short or pulverized fiber used to form a protective covering on metal or equivalent material. The roller 14 itself may be formed from any structural material. Suitable materials include steel, aluminum, and reinforced plastic. The roller 14 can be powered by a motor (not shown), having, for example, from 0.005 to 0.25 horsepower.

The elongated dimension of the element 16, i.e. that dimension which traverses the heating zone, is preferably parallel to the axis of the drive roller 14. Although the element 16 may be skewed at an angle (for example 5°, 10°, 20°, or even 60°) and curved to conform to the shape of the roller, the development process is not improved thereby. The length of the elongated dimension of the element 16 will usually exceed the lengths of the other dimensions of the element, i.e., the width and thickness of the element, which dimensions are shown in FIG. 4. The elements 16 should have a length greater than the width of the papers S to be processed.

The separations 24 between the elements 16 should be of sufficient size to allow moisture to escape from the paper. The heater 18 should also contain openings 26, located in the region of the separations 24 in order to allow escape of the moisture vapor from the area between the papers S and the elements 16.

Sufficient elements 16 must be present in order to provide sufficient heat conductive material for development. It is preferred that at least about 80 percent of the area of the heating zone be comprised of heat conductive elements 16, and that no more than 20 percent of the area of the heating zone be comprised of the separations 24 between the elements 16. In other words, it is preferred that at least 80 percent of the surface of any sheet of paper that is in the heating zone be in contact with heat conductive elements 16. However, there must be a sufficient amount of separation area 24 so that escape of moisture vapor from the heating zone is effective. Generally, at least about 10 percent of the area of the heating zone should be comprised of separations 24, or pores, slots, or the like.

At least three heat conductive elements 16 should be employed for a cylindrical heating zone when the circumference of which is an arc on the order of 180°. Preferably, however, the ratio of the width of the elongated element to the circumference of the arc formed by the heating zone should be less than about 1:4, more preferably about 1:5 to about 1:10. The width of the elongated element is that dimension of the element that, in combination with the widths of the other elements which make up the heat conductive member, is coextensive with the length or circumference of the heating zone of the developing device. Elongated elements having a smaller width may be desirable, but economic considerations will generally impose a lower limit on element width and an upper limit on the number of elements.

The heat conductive elements 16 may be supported in any of several manners. In the preferred embodiment, the heat conductive elements 16 are supported by the heater 18, which, in the case of the preferred embodiment, is in the form of a web. However, it is not essential that the heater 18 perform this dual function.

It is not required that the elements 16 be in contact with, adhered to, or fastened to a heater 18. The elements 10 may merely be linked together, as by a chain or any other connector that allows independent movement of the individual elements. The linked elements, then, would conform to the shape of the drive roller 14 during operation of the developing device. The heat, of course, could be supplied to the elements 16 by a means other than the heater 18. Examples of such means include cartridge heaters, lamps, electrodes, or even the drive roller 14 itself.

In the embodiment shown in FIG. 1, a supporting shaft 28—positioned at the axis of the drive roller 14 journals the roller for rotation relative to the walls 30 and 32 of frame 10. The heat conductive elements 34 and 36 at each end of the heater 18 are preferably bent away from the roller 14, to allow the paper to enter and exit easily. The elements 34 and 36 are preferably secured against movement. One of the end elements 34 may be fixedly mounted to the base 38 of frame 10 to prevent rotational movement of the heat conductive member. The other of the end elements 36 may be connected by a biasing means 40, e.g., a spring, to the top 42 of frame 10. By adjusting the tension of the spring biasing means 40, the pressure between the drive roller 14 and the heat conductive elements 16 can be adjusted. The light imaged paper S is inserted into the nip 44 between the drive roller 14 and the angled heat conducting element 36. The paper S is conveyed by the drive roller 14 over and against the heat conductive elements 16. The heat conductive elements 16 may be fastened to the heater 18 by any means, such as an adhesive or fastener, or they may be placed on the heater 18 without an adhesive or fastener. The heat conductive elements 34, 36 at each end of the heater 18 are preferably fastened to the heater 18, as by means of adhesives or fasteners.

The employment of a plurality of moveably associated heat conductive elements allows for independent movement of each element 16. Independent movement of the elements is significant in that it allows the drive roller 14 to apply substantially uniform pressure to the papers and films during processing, and uniform pressure is a key factor in providing uniform development. Because the moveable elements 16 are resiliently biased, as by spring 40, imperfections in the elements 16 and/or roller 14, e.g., depressions and/or protrusions, do not result in producing non-uniform pressure levels on the surface of the paper being developed.

Figure 5:
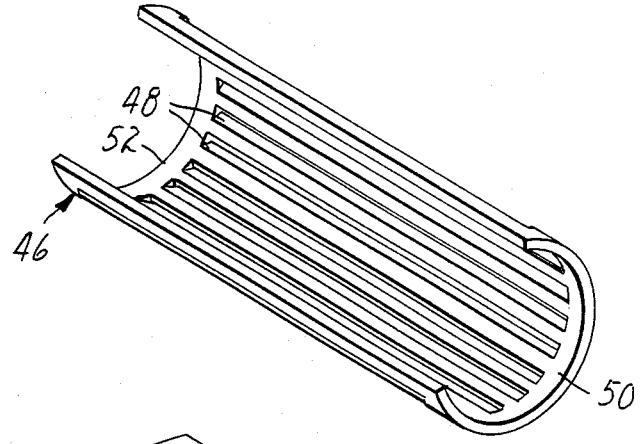
FIG. 5 is a perspective view of an alternative configuration of heat conducting member.

Another embodiment of the heat conductive member which is analogous to that of the embodiment shown in FIGS. 1–3 is shown in FIG. 5. The heat conductive member 46 is a unitary, hot shoe exhibiting a cylindrical curvature and having openings 48 formed therein to allow removal of moisture. The most preferred openings 48 are elongated slots running from a point on the member 46 slightly inset from one end 50 of the member 46 to a point on the member 46 slightly inset from the other end 52 of the member 46. It is also acceptable, but less preferred, to have slots formed in the hot shoe, which slots have lengths shorter than the length of the slots shown in FIG. 5. Although a hot shoe characterized by shorter, but more numerous slots, would exhibit greater structural stability and resistance to deformation than would the hot shoe characterized by slots of greater length, the hot shoe having shorter slots would probably not be as desirable with respect to moisture removal.

It is preferred that the elongated slots 48 run parallel to the axis of the heat conductive member 46 or drive roller; however, the slots 48 can be skewed from the axis while still maintaining effective heating and moisture removal.

It is important that there be sufficient heat conductive material to provide sufficient heating to papers and sufficient structural stability for the heat conductive member 46. It is preferred that from about 80 to about 90 percent of the surface area of heat conductive member 46 comprise heat conductive material. This value is based on the assumption that the heat conductive member 46 has substantially uniform thickness.

As with the elongated elements of the preferred embodiment, the member 46 may be made of any material which is capable of conducting heat. Heat may be also supplied to the heat conductive member 46 in manners similar to those employed in the preferred embodiment. However, this embodiment is inferior to the embodiment shown in FIGS. 1–3 with respect to uniformity in application of pressure, because the heat conductive member 46 does not allow for resilient biasing to accommodate imperfections in either the drive roller, the member 46, or both.

Figure 7:
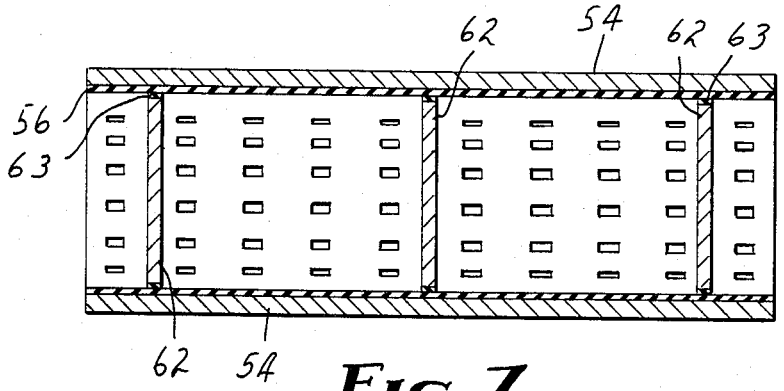
FIG. 7 is a sectional view taken along line 7—7 of FIG. 6.
Figure 6:
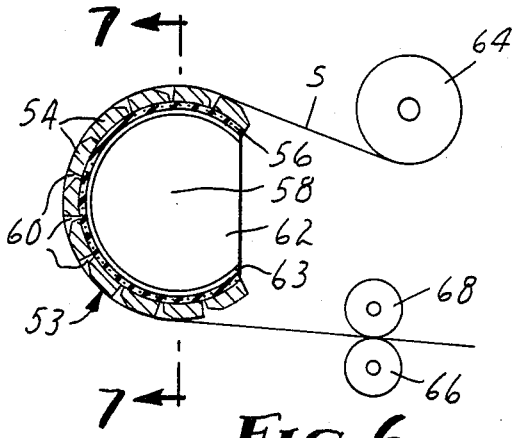
FIG. 6 is a vertical sectional view of an alternative embodiment of a processing device constructed according to the present invention.

Another embodiment of the heat conductive member is shown in FIGS. 6 and 7. The heat conductive member 53 is basically in the configuration of a drum. The heat conductive member 53 will be hereinafter referred as a drum; however, it is not a true drum; its configuration renders it drum-like. In this embodiment, a plurality of elongated elements 54, which are preferably in the shape of bars, are employed for conducting heat from the heat source 56 to the thermally imageable papers S. The moisture may be transferred from the paper S to the interior 58 of the drum through the separations 60 between the elements 54, or moisture may be released outwardly from the drum to the atmosphere.

The direction of moisture removal depends on whether the uncoated side of the base layer or the coated side of the base layer of the paper is in contact with the heat conductive member 53. The major portion of moisture borne by the paper escapes from the uncoated side of the base layer, i.e., the side opposite to that bearing the photothermographic layer. Therefore, if the photothermographic layer is in contact with the heat conductive elements 54, most of the moisture vapor will escape in a direction away from the interior 58 of the drum; conversely, if the base layer is in contact with the heat conductive elements 54, most of the moisture vapor will escape into the interior 58 of the drum through separations 60 between the elements 54.

In FIG. 6, the heat is supplied to the elements 54 by means of a heater 56 which is preferably in the form of a web. The elements 54 are supported by the heater. The heater in turn is supported by convenient structural means, e.g., sections 62 of a smaller, concentric cylinder mounted within the cylinder defined by the drum-like member 53. One or more sections 62 may be employed. Resilient pads 63 can be disposed between the heater 56 and the sections 62 to bias the elements 54 toward the pressure applying means, which will be described later. The resilient pads 63 may be made of rubber or other resilient material. Alternatively, the heater 56 and/or the sections 62 may be made of a resilient material. The elements 54 must be adhered to the web 56, as by an adhesive or by fasteners. If not so fastened, they will not remain in place on the peripheral surface of the drum-like member 53.

The simplest elements 54 exhibit a rectangular cross-section. However, cross-sections of other shapes are also acceptable. In the drum-like embodiment, it is preferred that the side of the element 54 in contact with and joined to the heater 56 be curved in order to be accommodated to the curvature of the heat conductive member 53. The heater 56 should have openings located in the region of the separations 60 to allow moisture to escape to the interior 58 of the member 53. The number of heat conductive elements 54, and the proportions of the heating zone allocated to heat conductive elements 54 and to separations 60 are substantially similar to the values given for the embodiment shown in FIGS. 1–3. Additionally, the heater 56, the separations between the heat conductive elements 54, the openings in the heater, and the shape of the heat conductive elements 54 may be substantially similar to the analogous parts in the embodiments described in FIGS. 1, 2, and 3.

The paper S can be furnished from a supply roll 64. Drive roller 66 and drive roller 68 define the path which the paper S follows to allow contact with the heat conductive elements 54 of the drum-like member 53. The surface of drive rollers 66 and 68 should have adequate tack to provide good frictional driving contact for the web of paper S. A motor (not shown) drives the drive rollers 66 and 68; thus the combination of motor, supply roll 64, drive roller 66, and drive roller 68 serves as the means for conveying the paper to and from the heat conductive elements 54. By tensioning the paper, pressure is applied against the elements 54 on the drum-like member 53. The paper supply roll 64 should include a braking mechanism (not shown) for this purpose. The heat conductive member 53 and drive rollers 66 and 68 can be mounted on a suitable frame (not shown).

As with the embodiment shown in FIG. 1, the heat conductive elements 54 are independently movable. Thus, when the paper is placed under tension, as, for example, by the supply roll 64, the rollers 66 and 68, the independent movability of the elements 54 allows the paper itself to be subjected to substantially uniform pressure, which aids in promoting uniform development. The resiliency of the resilient pads 63 biases the elements 54 toward the pressure applying means, which, in this case, can be construed as the paper S itself. Because the elements 54 are resiliently biased, imperfections in the elements 54 or the paper S itself, do not result in producing non-uniform pressure levels on the paper being developed.

Figure 8:
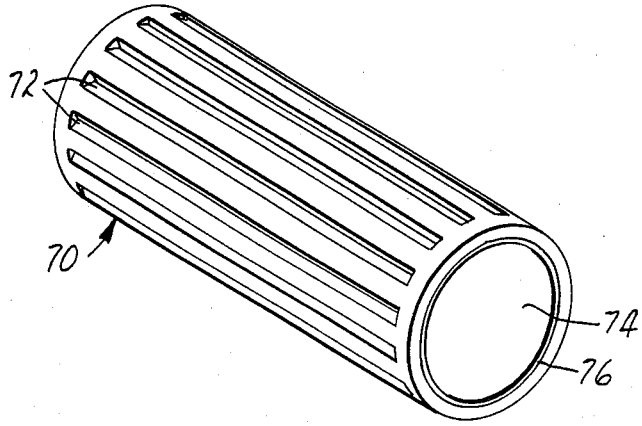
FIG. 8 is a perspective view of an alternative embodiment of a processing device constructed according to the present invention.

In a similar embodiment, shown in FIG. 8, the heat conductive member 70 may be constructed in the form of a cylindrical drum. The cylindrical drum 70 is formed from a unitary heat conductive material, rather than being comprised of a plurality of elongated elements. Openings 72 are formed in the drum 70, so that moisture from the paper can be transferred from the paper, through the openings 72, into the interior 74 of the drum 70. The openings 72 may be similar to those described in the embodiment illustrated in FIG. 5. The paper may be transported to and from the drum 70 in the same manner as shown in FIG. 6.

As with the embodiment shown in FIG. 6, heat may be supplied to the heat conductive member 70 by means of a heater 76 which is preferably in the form of a web. The heater 76 may be simply fastened to or adhered to the interior side of the heat conductive member 70. The heater 76 should have openings located in the region of the openings 72 to allow moisture to escape from the paper. The embodiment of FIG. 8 is less preferred than the one described in FIG. 6, due to the absence of means for providing for uniformity in application of pressure.

Figure 9:
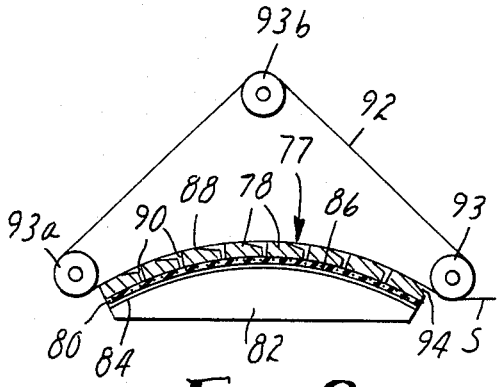
FIG. 9 is a vertical sectional view of an alternative embodiment of a processing device constructed according to the present invention.

Another embodiment of the heat conductive member is shown in FIG. 9. The heat conductive member 77 is in the form of a platen. The heat conductive member 77 is not a true platen; however, its configuration is similar to that of a platen. The platen-like embodiment is formed from a plurality of elongated elements 78, which elements conduct heat from the heater 80 to the paper S. The elongated elements 78 are preferably in the shape of bars. The elements 78 are supported by the heater 80. As with the embodiment of FIG. 6, the heater can be supported by convenient structural means, e.g. sections 82 of smaller, concentric arcs mounted within the arc defined by the platen. One or more arc sections 82 may be employed. As with the embodiment shown in FIG. 6, resilient pads 84 can be disposed between the heater 80 and the sections 82 to bias the elements 78 toward the pressure applying means, which will be described later. The resilient pads 84 may be made of rubber or other resilient material. Alternatively, heater 80 and/or sections 82 may be made of a resilient material. Although it is shown that the heater 80 is in contact with the concave portion 86 of the heat conductive member 77 and the paper S is in contact with the convex portion 88 of the member 77, it is suitable under certain conditions to have the heater 80 in contact with the convex portion 88 and the paper S in contact with the concave portion 86. As with the embodiment shown in FIG. 6, the moisture is transferred from the paper S through separations 90 between the elongated elements 78. As in the embodiments shown previously, the heater 80 should have openings located in the region of the separations 90 to allow moisture to escape from the papers.

The pressure applying member can be an endless belt 92 which presses the paper S against the elements 78. The belt 92 may be a conveyor belt of the type used in conventional thermal developing units. The belt 92 can be driven by drive rollers 93, 93*a* and 93*b*, which can be driven by a motor (not shown). The paper S is inserted into the nip 94 between the belt 92 and the heat conductive member 77 and conveyed by the belt over and against the elongated elements 78.

The heater 80, the heat conductive elements 78, the separations 90, and the openings in the heater may be substantially similar to the analogous parts in the embodiments described in FIGS. 1, 2, and 3. The proportions of the heating zone allocated to heat conductive elements 78 and to separations 90 may be substantially similar to the values given for the embodiments shown in FIGS. 1–3. The heat conductive member 77, belt 92, and drive rollers 93, 93*a*, 93*b* can be mounted on a suitable frame (not shown).

As in the embodiment shown in FIG. 1, the heat conductive elements 78 are independently movable. This independent movement capability allows the pressure applying means, i.e., the endless belt 92, to apply substantially uniform pressure to the papers and films during thermal processing. By using a resilient material to support the heat conductive elements 78, the moveable elements 78 are resiliently biased toward the pressure applying means, thus minimizing the undesirable effect of imperfections in the elements 78, belt 92, and/or paper S, which imperfections might result in producing non-uniform pressure levels on the surface of the paper being developed.

Figure 10:
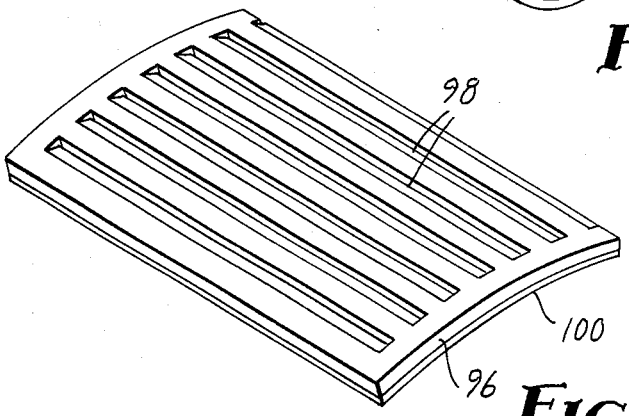
FIG. 10 is a perspective view of an alternative embodiment of a processing device constructed according to the present invention.

Another embodiment of heat conducting element employing the platen configuration is shown in FIG. 10. The platen 96 is a unitary construction, rather than being formed from a plurality of heat conducting elements. Openings 98 are formed in the platen 96, so that moisture vapor from the paper can be removed through the openings 98. The openings 98 are similar to those described in the embodiments of FIGS. 5 and 8. The platen 96 may be heated by a heater 100 which is substantially similar to heater 80. As with heater 80, the heater 100 should have openings in the region of the openings 98 to allow moisture to escape from the papers. The embodiment is less preferred than the one described in FIG. 9, because of the absence of means for providing for uniformity in application of pressure.

In any of the foregoing embodiments, uniform pressure is most advantageously applied when the major dimension, i.e., the length dimension, of the elongated elements 16, 54, 78 is substantially parallel to the axis of the drive roller 14, the axis of the drum-like embodiment of FIG. 6, or the axis of the arc defined by the platen-like embodiment of FIG. 9, respectively. As these elements deviate from being parallel to these axes, pressure across the surface of the paper becomes less uniform. Because uniformity in pressure leads to uniformity in moisture removal, it is highly desirable to keep the elements approximately parallel to the appropriate axis.

The heat conductive member must be heated to a temperature sufficient to develop the paper or film. The precise temperature is dependent upon the paper or film employed.

One type of paper which is amenable to thermal processing by means of the present invention is that disclosed in Morgan et al, U.S. Pat. No. 3,457,075.

The processing device of the present invention can be used in combination with other apparatus used with photothermographic film. For example, the thermal processor may be a module to be connected in sequence with an imaging device or an integral part of that device. The imaging device could be one that provides imagewise exposure of the paper or film by transmission of actinic radiation (e.g., light) through a negative transparency, projection of digitized laser emissions, electrostatic charge imaging or any other source of imaging energy that would form a latent image which is subsequently to be thermally developed. Both the imaging device and the thermal processor may also be part of a further system wherein electronic information may be initially provided from a camera, video cathode tube, line data transmission or any other source which can then be converted to an imagewise exposure on the thermographically developable paper or film in the imaging device.

METHOD OF OPERATION

A suitable photothermographic paper which can be utilized is 3M Type 7772, disclosed in U.S. Pat. No. 3,457,075, which is developed by the application of heat to a temperature of approximately 120° C. for a period of about 6 seconds. Description of operation will proceed on the basis of this particular paper. It is to be understood, however, that the scope of the invention is not to be limited to the utilization of any specific photothermographic paper or film and is generally applicable to any flexible recording medium where a latent image is first formed and is then developed by heating at temperatures of between 80° C. and 200° C. for a predetermined period of time in order to develop the latent image into a visible image.

Referring now to FIG. 1, the paper S moves at approximately 2 inches per second. For purposes of description, the paper enters the developing apparatus at room temperature or approximately 20° C.

The light imaged paper S is inserted into the nip 44 between the drive roller 14 and the angled heat conducting element 36. Spring 40 has been adjusted to provide adequate pressure between the heat conducting elements 16 and the drive roller 14. As the paper S moves along the path defined by the drive roller 14 and the elongated elements 16, it absorbs heat from the elements 16, thus resulting in development of the visual image. Moisture from the paper is released through the separations 24 between the elements 16.

Compared to images formed by use of thermal developing devices currently used, the thermal developing devices of the present invention exhibit superiority with respect to consistency of visual image development, particularly in humid environments.

The following is an example of possible design parameters for a device according to the present invention. A device comprising a cylindrical drive roller 14 having a diameter of 3 inches and a length of 10 inches, elongated elements 16 having a length of 10 inches and a cross-section of $\frac{1}{8}$ inch$\times\frac{1}{2}$ inch, and which elements are provided with a 500 watt heater, is capable of developing $8\frac{1}{2}$ inch wide heat developable paper at a rate of up to 10 feet per minute.

What is claimed is:

1. Device for thermally developing papers and films which are developable by heat comprising:

(a) a heat conductive member defining a partially-cylindrical heating zone through which said papers and films may be moved to effect development, said heat conductive member comprising a plurality of independently moveable, elongated, bar-shaped heat conductive elements arranged in an arcuate array about said zone so that spaces exist between said elements, (b) pressure applying means for pressing said papers and films against said heat conductive member, (c) means for preventing rotational movement of said heat conductive member, (d) means for heating said heat conductive elements, and (e) means for resiliantly biasing said heating means and said elements toward and into contact with said papers and films which are moved through said zone, whereby said papers and films are heated for development, and moisture vapor released from said papers and films may pass through said spaces to restrict uneven development within said zone.

2. The device of claim 1 wherein said heat conductive member is in the configuration of a shoe.

3. The device of claim 1 wherein said heat conductive member is essentially in the configuration of a drum.

4. The device of claim 1 wherein said heat conductive member is in the configuration of a platen.

5. The device of claim 1 wherein said elements have their major dimension essentially parallel to the axis of the heating zone.

6. The device of claim 1 wherein the leading edge of each element is bevelled.

7. Apparatus for preparing images by imagewise exposure by actinic radiation of a photothermographic film or paper and subsequent thermal development comprising (a) a means for providing a latent image by exposure to actinic radiation in combination with (b) a device for thermally developing papers and films which are developable by heat comprising (1) a unitary heat conductive member defining a partially-cylindrical heating zone through which said papers and films may be moved to effect development, said heat conductive member having means within said heating zone to allow removal of moisture vapor from the surface of said papers and films, said moisture vapor removal means comprising a plurality of elongated slots that are parallel to the axis of said heat conductive member, (2) pressure applying means for pressing said papers and films against said heat conductive member, (3) means for preventing rotational movement of said heat conductive member, and (4) means for heating said heat conductive member, whereby said papers and films are heated for development, and moisture vapor released from said papers and films may pass through said slots to restrict uneven development within said zone.

8. Apparatus for preparing images by imagewise exposure by actinic radiation of a photothermographic film or paper and subsequent thermal development comprising (a) a means for providing a latent image by exposure to actinic radiation in combination with (b) a device for thermally developing papers and films which are developable by heat comprising (1) a heat conductive member defining a partially-cylindrical heating zone through which said papers and films may be moved to effect development, said heat conductive member comprising a plurality of independently moveable, elongated, bar-shaped heat conductive elements arranged in an arcuate array about said zone so that spaces exist between said elements, (2) pressure applying means for pressing said papers and films against said heat conductive member, (3) means for preventing rotational movement of said heat conductive member, (4) means for heating said heat conductive elements, and (5) means for resiliantly biasing said heating means and said elements toward and into contact with said papers and films which are moved through said zone, whereby said papers and films are heated for development, and moisture vapor released from said papers and films may pass through said spaces to restrict uneven development within said zone.

* * * * *